US009650876B2

(12) United States Patent
Hill et al.

(10) Patent No.: US 9,650,876 B2
(45) Date of Patent: May 16, 2017

(54) METHOD OF BALANCING RESOURCE RECOVERY FROM A RESOURCE BEARING FORMATION

(71) Applicants: Freeman L. Hill, Spring, TX (US); Cameron J. McBurney, Houston, TX (US); Caleb M. Conrad, Anchorage, AK (US)

(72) Inventors: Freeman L. Hill, Spring, TX (US); Cameron J. McBurney, Houston, TX (US); Caleb M. Conrad, Anchorage, AK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 199 days.

(21) Appl. No.: 14/585,883

(22) Filed: Dec. 30, 2014

(65) Prior Publication Data

US 2016/0186539 A1 Jun. 30, 2016

(51) Int. Cl.
*E21B 43/16* (2006.01)

(52) U.S. Cl.
CPC ..... *E21B 43/16* (2013.01)

(58) Field of Classification Search
CPC ..... E21B 43/16; E21B 41/0092
See application file for complete search history.

(56) References Cited

U.S. PATENT DOCUMENTS 3,380,526 A * 4/1968 Altamira ..... E21B 43/30 166/245
5,339,897 A * 8/1994 Leaute ..... E21B 43/305 166/245
8,417,496 B2 * 4/2013 Main ..... E21B 49/00 703/1
2002/0099505 A1 * 7/2002 Thomas ..... E21B 43/20 702/12
2009/0276100 A1 11/2009 Malki et al.
2011/0146982 A1 * 6/2011 Kaminsky ..... E21B 43/247 166/272.2

(Continued)

FOREIGN PATENT DOCUMENTS

WO 0124099 A1 4/2001

OTHER PUBLICATIONS

International Search Report and Written Opinion of the International Search Authority issued in related PCT Application No. PCT/US2015/061908 on Mar. 2, 2016, 9 pages.

*Primary Examiner* — Shane Bomar
(74) *Attorney, Agent, or Firm* — Cantor Colburn LLP

(57) ABSTRACT

A method of recovering resources from a resource bearing formation includes selectively injecting a fluid into the resource bearing formation through one or more injector wells, extracting a resource from the resource bearing formation through one or more production wells, receiving at a sweep pattern controller, an input from each of the one or more production wells indicating an amount of the resource extracted over a period of time, determining, in the sweep pattern controller, an adjusted sweep pattern for the formation that substantially equalizes production from each of the one or more production wells, and signaling each of the one or more injector wells, from the sweep pattern controller, to selectively inject the fluid to establish the adjusted sweep pattern in the formation.

9 Claims, 3 Drawing Sheets

(56) References Cited

U.S. PATENT DOCUMENTS

| | | | | |
|---|---|---|---|---|
| 2011/0229071 | A1* | 9/2011 | Vincelette | E21B 43/2406<br>385/13 |
| 2012/0191432 | A1 | 7/2012 | Khataniar et al. | |
| 2012/0296618 | A1 | 11/2012 | Hocker | |
| 2014/0006111 | A1* | 1/2014 | Priyesh | G06Q 10/0637<br>705/7.36 |
| 2016/0061020 | A1* | 3/2016 | Sayarpour | E21B 43/14<br>166/250.01 |

* cited by examiner

METHOD OF BALANCING RESOURCE RECOVERY FROM A RESOURCE BEARING FORMATION

BACKGROUND

Exemplary embodiments pertain to the art of resource, extraction, recovery and sequestration systems and, more particularly, to a method and apparatus for balancing resource recovery from a resource bearing formation.

Many hydrocarbon extraction systems employ artificial lift to aid in resource recovery. In some instances, the fluid is extracted from the formation through the use of a mechanical device that may be arranged inside a production well (known as pump or velocity string) or by decreasing the weight of a hydrostatic column by injecting gas into the production fluid. Artificial lift is generally employed in wells when there is insufficient reservoir pressure to lift the production fluids uphole. In cases of enhanced oil recovery, fluids and gases are pumped into a formation to provide an artificial means to increase the flow of a production fluid, such as crude oil, and/or water from a production well.

In some cases, fluid, which may take the form of liquid or gas, may be introduced into the formation at multiple locations through injector wells and then produced from production wells. The result of this movement in the subsurface is the sweep pattern and sweep efficiency of the paired injection and production wells. In this manner, fluid injection and/or production may be controlled or adjusted to improve the sweep pattern or efficiency to improve hydrocarbon recovery from the reservoir.

SUMMARY

A method of balancing resource recovery from a resource bearing formation includes selectively injecting a fluid into the resource bearing formation through one or more injector wells, extracting a resource from the resource bearing formation through one or more production wells, receiving at a sweep pattern controller, an input from each of the one or more production wells indicating an amount of the resource extracted over a period of time, determining, in the sweep pattern controller, an adjusted sweep pattern for the formation that substantially equalizes production from each of the one or more production wells, and signaling each of the one or more injector wells, from the sweep pattern controller, to selectively inject the fluid to establish the adjusted sweep pattern in the formation.

A resource recovery system includes one or more production wells fluidically connected to a resource bearing formation. The one or more production wells are configured to extract a resource from the resource bearing formation. One or more injector wells are fluidically connected to the resource bearing formation. The one or more injector wells are configured to selectively inject a fluid into, and increase pressure within, the resource bearing formation. A sweep pattern controller is operatively connected to each of the one or more production wells and each of the one or more injector wells. The sweep pattern controller is configured and disposed to selectively control one or more of the one or more injector wells to establish a desired sweep pattern, in the resource bearing formation, to substantially equalize resource extraction from each of the one or more production wells.

BRIEF DESCRIPTION OF THE DRAWINGS

Referring now to the drawings wherein like elements are numbered alike in the several Figures.

DETAILED DESCRIPTION

Figure 1:
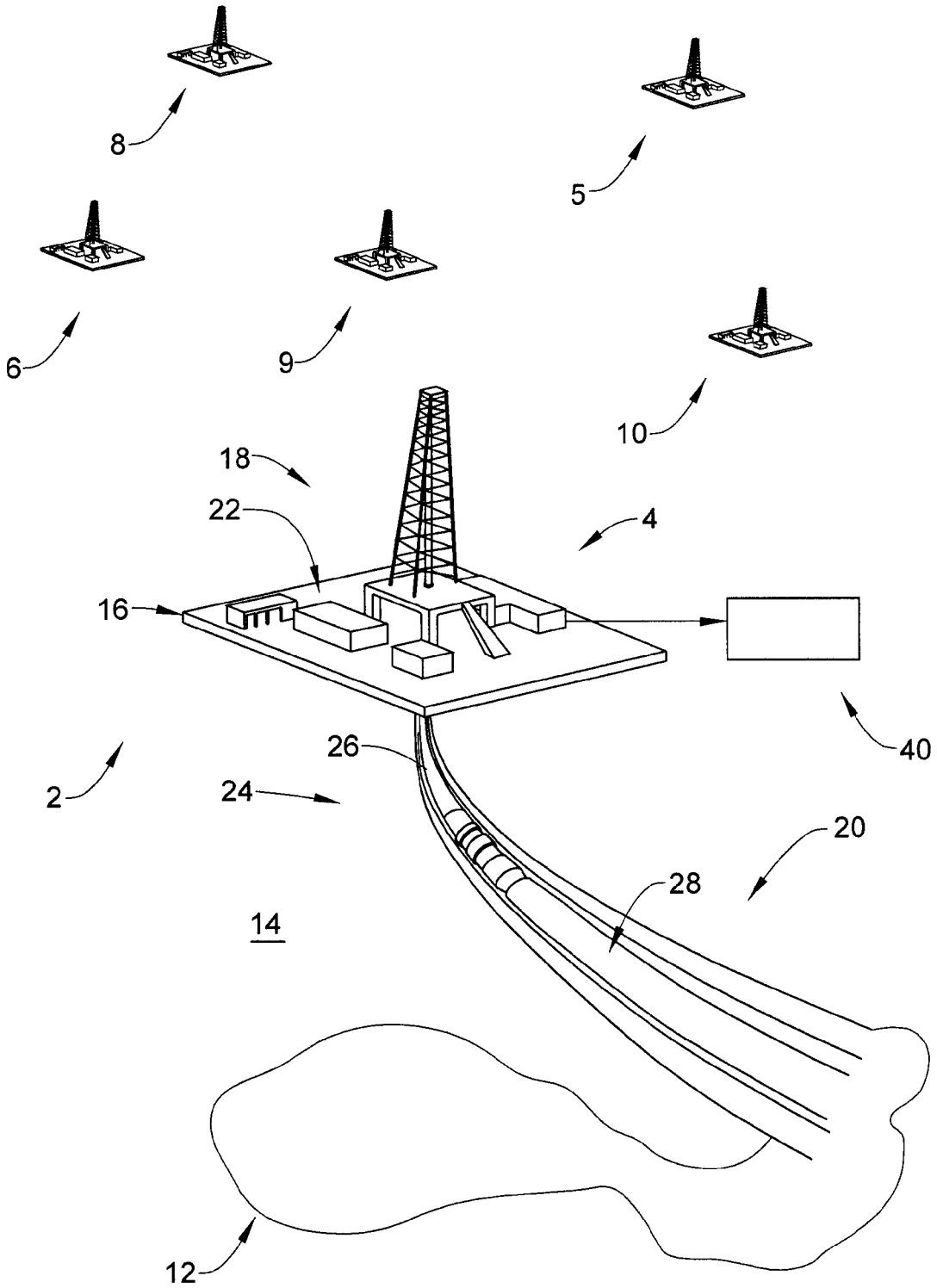
FIG. 1 depicts a resource extraction, recovery and/or sequestration system including production wells and injector wells fluidically connected to a resource bearing formation, in accordance with an exemplary embodiment.

A resource extraction, recovery and/or sequestration system, in accordance with an exemplary embodiment, is indicated generally at 2, in FIG. 1. Resource extraction, recovery and/or sequestration system 2 includes a plurality of production or producing wells 4-6 and a plurality of injector wells 8-10. Production wells 4-6 and injector wells 8-10 are fluidically connected to reservoir 12 formed in a resource bearing formation 14. Of course it should be understood that the number of production wells and/or injector wells may vary. Production well 4 includes a platform 16 that supports a surface system 18 operatively connected to a downhole system 20 that extends into reservoir 12. Surface system 18 may include pumps 22. Downhole system 20 may include a downhole string 24 that is extended into a wellbore 26 formed in formation 14. Downhole string 24 may include a number of connected downhole tubulars or conduits 28 that deliver a resource (not separately labeled) from reservoir 12 to surface system 18 for delivery to a storage area and/or refinery (not shown). Injector wells 8-10 introduce a fluid, which may be a liquid, a gas or a combination thereof, into reservoir 12 causing the resource to flow uphole through production wells 4-6.

Figure 2:
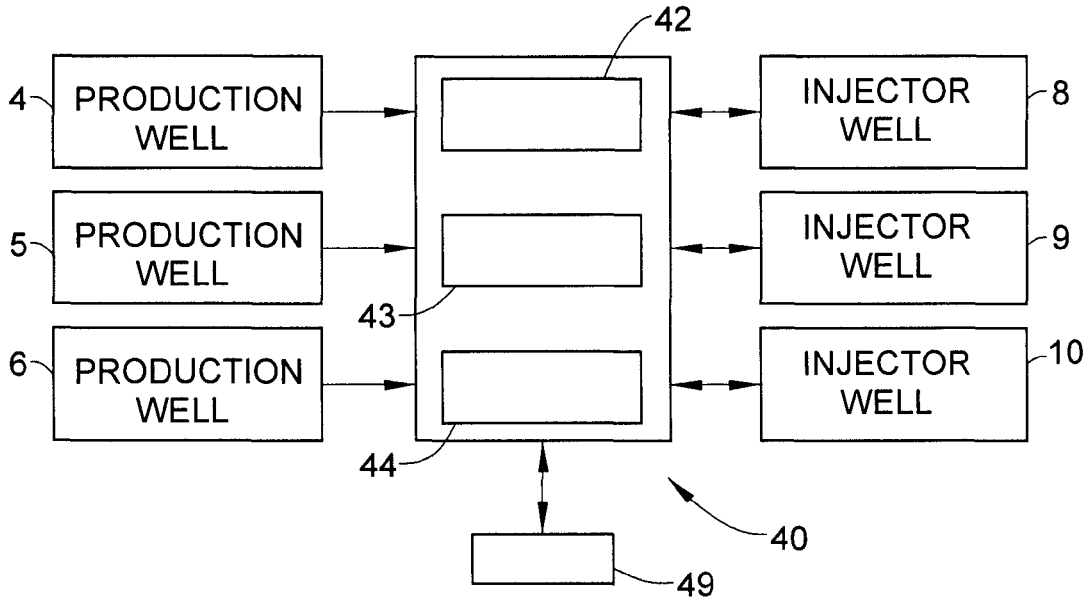
FIG. 2 depicts a sweep pattern controller that selectively controls fluid injection into the resource bearing formation through the injector wells to establish a desired sweep pattern.

In accordance with an exemplary embodiment, resource extraction, recovery and/or sequestration system 2 includes a sweep pattern controller 40 that determines a desired sweep pattern for reservoir 12 that results in a substantially balanced resource output through each of production wells 4-6. As shown in FIG. 2, sweep pattern controller 40 is operatively connected to each of production wells 4-6 and injector wells 8-10 and includes a central processor unit (CPU) 42, a memory 43, and a sweep pattern simulation module 44. Sweep pattern controller 40 may also be operatively linked with a remote monitoring and control system 49.

As will be detailed below, sweep pattern controller 40 receives inputs from each of production wells 4-6 and injector wells 8-10. Inputs from production wells 4-6 may include an amount of resource extracted for a given period of time, a rate of extraction for the period of time, an amount of injected fluid extracted, and the like. Inputs from injector wells 8-10 may include a pressure of injected fluid and a flow rate of injected fluid. Injected fluid may be a liquid such as water or a gas. Based on one or more of the inputs, sweep pattern controller 40 determines, or adjusts, a sweep pattern or injected fluid pattern to establish uniformity between production wells 4-6. The sweep pattern may be established by controlling one, the other, or both of injected fluid pressure and a rate of injected fluid flow. That is, sweep pattern controller 40 controls pressure and/or rate of injected fluid flow from one or more of injector wells 8-10 to establish a substantially uniform, or substantially balanced, output between production wells 4-6.

Figure 3:
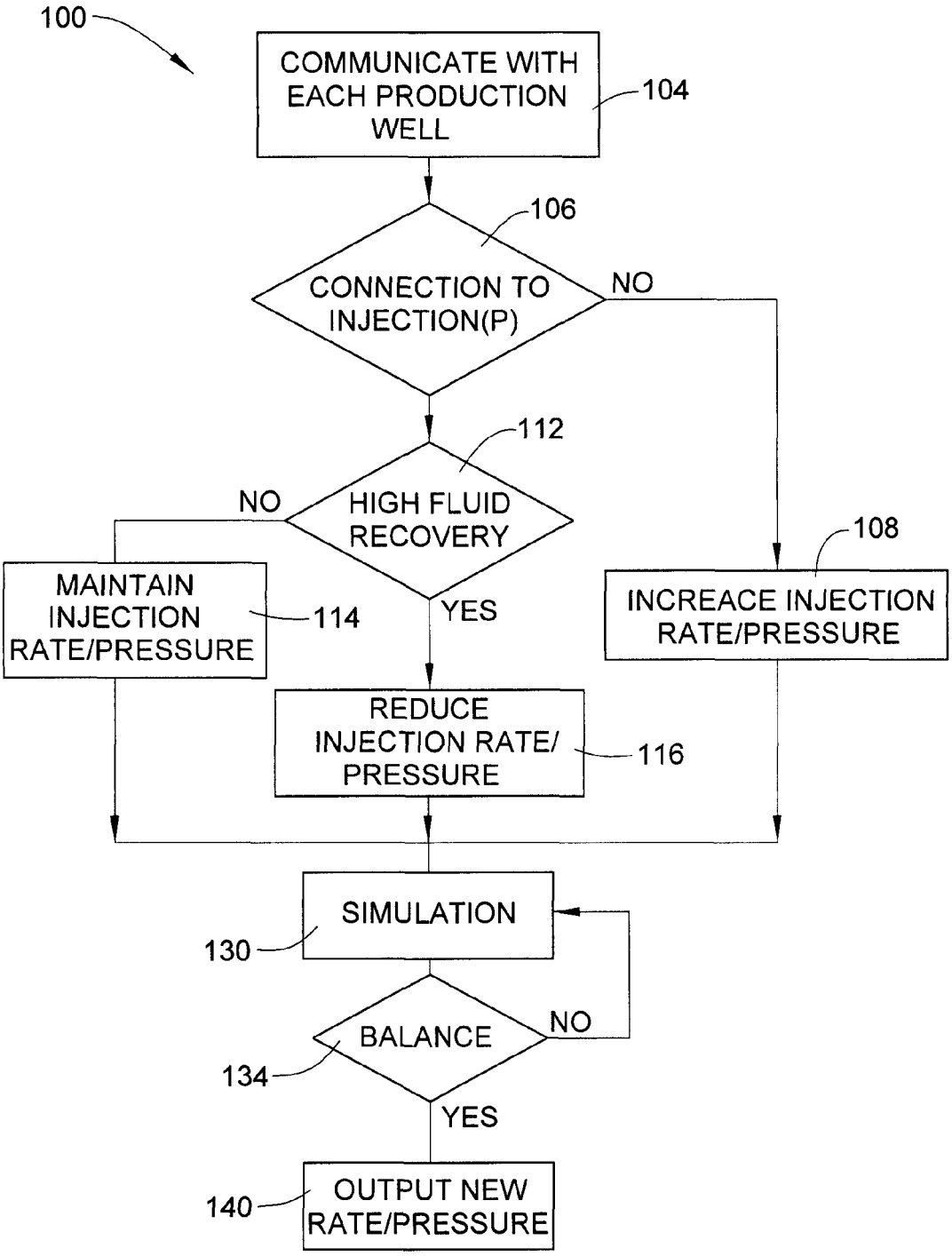
FIG. 3 depicts a flow diagram illustrating a method of balancing resource recovery from the resource bearing formation, in accordance with an exemplary embodiment.

Reference will now follow to FIG. 3 in describing a method 100 of establishing uniformity, or balance, between production wells 4-6. In block 104, sweep pattern controller 40 communicates with each of production wells 4-6 to determine various production well parameters such as the amount of resource extracted, the rate of resource extraction, and the amount of injected fluid extracted. A determination is made in, block 106, whether a connection exists between production well parameters and injected fluid. For example, a connection may be determined by measuring injection fluid mixed with the extracted resource. If little or no connection exists, sweep pattern controller 40 may determine that injection pressure and/or a rate of injection should be increased for one or more of injector wells 8-10, in block 108. If a connection exists, sweep pattern controller 40 determines, in block 112, a percentage of injected fluid mixed with the extracted resource.

If the percentage of fluid is below a selected threshold sweep pattern controller 40 may determine that no change in injected fluid pressure and/or a rate of injection is desirable for one or more of injector wells 8-10, in block 114. If, on the other hand, the percentage is above the selected threshold sweep pattern controller 40 may determine that injected fluid pressure and/or a rate of injection should be reduced at one or more of injector wells 8-10, in block 116. The specific nature of the selected threshold may vary depending upon field conditions. After determining whether a change in pressure and/or rate of injection is indicated, sweep pattern controller 40 directs inputs to sweep pattern simulation module 44 in block 130. Sweep pattern simulation module 44 simulates a response at each production well 4-6 based on proposed changes to each injector well 8-10.

If the proposed changes indicate that the proposed changes to pressure and/or rate of injection to each injector well 8-10 leads to uniformity at each production well 4-6, in block 134, sweep pattern controller 40 communicates an adjusted sweep pattern to each of injector wells 8-10, in block 140. More specifically, sweep pattern controller 40 communicates a new pressure and/or rate of injection to each injector well 8-10 to establish the adjusted sweep pattern. If, sweep pattern simulation module 44 indicates that heterogeneity exists at production wells 4-6, a new simulation may be run employing adjusted input variables. That is, sweep pattern controller 40 will provide further adjustments to pressure and/or rates of injection to sweep pattern simulation module 44 for a new simulation.

At this point, it should be understood that the exemplary embodiments describe a system for establishing uniformity, or balance, in rates of extraction between production wells that rely on artificial lift to move resources uphole. The system employs a sweep pattern controller that determines a desired sweep pattern or injection fluid pressure and/or rate of injection fluid flow for each of a plurality of injector wells fluidically coupled to a resource bearing formation. The sweep pattern controller may perform one or more sweep pattern simulations to determine whether changes to injection fluid pressure and/or rate of injection fluid flow at one or more of the injector wells leads to uniformity at the production wells.

It should also be understood that the changes may represent an increase or a decrease in one, the other, or both of injection fluid pressure and/or a rate of injection fluid flow. Further, it should be understood that the changes, either as an increase or a decrease, may not be the same in either magnitude or direction for each parameter, e.g., injection fluid pressure and rate of injection fluid flow. Still further, it should be understood that changes may signify no change in either one or the other of the injection fluid pressure and the rate of injection fluid flow.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of balancing resource recovery from a resource bearing formation, the method comprising:

selectively injecting a fluid into the resource bearing formation through a plurality of injector wells;

extracting a resource from the resource bearing formation through one or more production wells;

receiving, at a sweep pattern controller, an input from each of the one or more production wells indicating an amount of the resource extracted over a period of time;

determining, in the sweep pattern controller, an adjusted sweep pattern for the formation that substantially equalizes production from each of the one or more production wells based on a threshold amount of injected fluid mixed with the extracted resource; and signaling each of the plurality of injector wells, from the sweep pattern controller, to selectively inject the fluid to establish the adjusted sweep pattern in the formation.

2. The method of claim 1, wherein determining the sweep pattern includes generating a sweep pattern simulation based on the input from each of the one or more production wells.

3. The method of claim 1, further comprising: determining a correlation between injecting the fluid into the resource bearing formation and an amount of the resource extracted through each of the one or more production wells.

4. The method of claim 3, further comprising: adjusting fluid injection into the resource bearing formation based on the correlation between injecting the fluid and the amount of resource extracted.

5. The method of claim 3, wherein determining the correlation between injecting the fluid into the resource bearing formation and an amount of resource extracted through each of the one or more production wells includes sensing an amount of the fluid injected into the resource bearing formation passing through each of the one or more production wells.

6. The method of claim 1, further comprising: performing a sweep pattern simulation of the adjusted sweep pattern to determine that production from each of the one or more production wells would be substantially equal.

7. The method of claim 6, further comprising: modifying the adjusted sweep pattern if the sweep pattern simulation indicates that production from each of the one or more production wells would not be substantially equal.

8. A resource recovery system comprising:

one or more production wells fluidically connected to a resource bearing formation, the one or more production wells being configured to extract a resource from the resource bearing formation;

a plurality of injector wells fluidically connected to the resource bearing formation, the plurality of injector wells being configured to selectively inject a fluid into, and increase pressure within, the resource bearing formation; and a sweep pattern controller operatively connected to each of the one or more production wells and each of the plurality of injector wells, the sweep pattern controller being configured and disposed to selectively control one or more of the plurality of injector wells to establish a desired sweep pattern in the resource bearing formation to substantially equalize resource extraction from each of the one or more production wells, wherein the sweep pattern controller is further configured to calculate an adjusted sweep pattern that substantially equalizes production from each of the one or more production wells based on the sweep pattern simulation based on a threshold amount of injected fluid mixed with the extracted resource.

9. The resource recovery system according to claim 8, wherein the sweep pattern controller includes a sweep pattern simulation module configured and disposed to generate a sweep pattern simulation to determine a resource extraction balance for the one or more production wells.

* * * * *